US010527339B2

(12) United States Patent
Hunter et al.

(10) Patent No.: US 10,527,339 B2
(45) Date of Patent: Jan. 7, 2020

(54) REFRIGERATOR APPLIANCE

(71) Applicant: Haier US Appliance Solutions, Inc., Wilmington, DE (US)

(72) Inventors: Matthew Hunter, Louisville, KY (US); Stephanos Kyriacou, Louisville, KY (US); Stephen Bernard Froelicher, Shepherdsville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 140 days.

(21) Appl. No.: 15/610,716

(22) Filed: Jun. 1, 2017

(65) Prior Publication Data

US 2018/0347888 A1 Dec. 6, 2018

(51) Int. Cl.
*F25D 17/06* (2006.01)

(52) U.S. Cl.
CPC ..... *F25D 17/065* (2013.01); *F25D 2317/062* (2013.01); *F25D 2317/065* (2013.01); *F25D 2317/066* (2013.01); *F25D 2317/0671* (2013.01)

(58) Field of Classification Search
CPC ..... F25D 17/065; F25D 17/08; F25D 17/062; F25D 2317/061; F25D 2317/062; F25D 23/04; F25D 23/12; F25D 19/006
See application file for complete search history.

(56) References Cited

U.S. PATENT DOCUMENTS 5,946,934 A 9/1999 Kim et al.
6,945,068 B2 9/2005 Kim et al.
7,076,967 B2 7/2006 Lee et al.
7,222,498 B2 5/2007 Lee et al.
7,228,703 B2 6/2007 Kim et al.
7,614,244 B2 11/2009 Venkatakrishnan et al.
8,099,975 B2 1/2012 Rafalovich et al.
8,132,423 B2 3/2012 Tikhonov et al.
8,371,136 B2 2/2013 Venkatakrishnan et al.
RE45,779 E 10/2015 Najewicz
2010/0251744 A1 10/2010 Yun et al.
2012/0304667 A1* 12/2012 Shin ..... F25D 17/065 62/3.6
2018/0164017 A1* 6/2018 Jeong ..... F25D 17/065

FOREIGN PATENT DOCUMENTS

CN 102679664 A 9/2012
CN 102706067 A 10/2012

* cited by examiner

*Primary Examiner* — Jianying C Atkisson
*Assistant Examiner* — Jose O Class-Quinones
(74) *Attorney, Agent, or Firm* — Dority & Manning, P.A.

(57) ABSTRACT

A refrigerator appliance is provided herein. The refrigerator appliance may include a cabinet, a door, a secondary liner, and a heat exchange case. The cabinet may include an internal liner defining a freezer chamber and a fresh food chamber. The door may be attached to the cabinet. The secondary liner may be attached to the cabinet and define a sub-compartment in fluid isolation from the freezer chamber and the fresh food chamber. The heat exchange case may be attached to the internal liner at the freezer chamber in conductive thermal communication therewith. The heat exchange case may at least partially define a convection compartment along a portion of the internal liner. The convection compartment may be defined in fluid isolation from the freezer and in fluid communication with the sub-compartment.

12 Claims, 15 Drawing Sheets

REFRIGERATOR APPLIANCE

FIELD OF THE INVENTION

The present subject matter relates generally to refrigeration appliances, and more particularly to refrigeration appliances including features for making ice.

BACKGROUND OF THE INVENTION

Certain appliances, such as refrigerator appliances, generally include an icemaker. In order to produce ice, liquid water is directed to the icemaker and frozen. After being frozen, ice may be stored within a storage bin appliance. In order to ensure ice is formed and/or remains in a frozen state, the icemaker and bin may be mounted within a chilled portion of the appliance. For instance, some conventional appliances provide an icemaker and storage bin within a freezer compartment. Other conventional appliances provide the icemaker and storage bin within a separate sub-compartment, e.g., within a door. In order to maintain efficient operation of the appliance, these conventional appliances generally provide an air circulation system to continuously circulate air within the sub-compartment with air within the freezer compartment.

Certain drawbacks exist with these conventional appliances. For instance, air within the freezer may be affected by the items stored within the freezer. Foul or unpleasant odors may be conveyed to the icemaker and/or storage bin. Over time, the odors within the air may taint the flavor or texture of the ice within the appliance. Moreover, in some conventional systems (e.g., appliances having a separate sub-compartment for the icemaker and/or storage bin), circulating air may generate an undesirable temperature gradient within the freezer. Specifically, relatively warm air conveyed from a separate sub-compartment may rapidly increase a localized temperature within the freezer compartment. In some instances, this may lead to some items within the freezer compartment reaching an undesirable temperature. Although separate evaporators or cooling components may be provided to reduce the temperature gradient (i.e., the effects of relatively warm sub-compartment air), such components may generally increase the complexity and overall inefficiency of the appliance. Moreover, such components may be difficult to effectively and consistently control.

In turn, it would be advantageous to provide a refrigerator appliance having features for addressing one or more of the above-described issues.

BRIEF DESCRIPTION OF THE INVENTION

Aspects and advantages of the invention will be set forth in part in the following description, or may be obvious from the description, or may be learned through practice of the invention.

In one aspect of the present disclosure, a refrigerator appliance is provided. The refrigerator appliance may include a cabinet, a door, a secondary liner, and a heat exchange case. The cabinet may include an internal liner defining a freezer chamber and a fresh food chamber. The door may be attached to the cabinet to selectively restrict access to the fresh food chamber or the freezer chamber in a closed position. The secondary liner may be attached to the cabinet. The secondary liner may define a sub-compartment in fluid isolation from the freezer chamber and the fresh food chamber in the closed position. The heat exchange case may be attached to the internal liner at the freezer chamber in conductive thermal communication therewith. The heat exchange case may at least partially define a convection compartment along a portion of the internal liner to direct heat to the freezer chamber. The convection compartment may be defined in fluid isolation from the freezer and in fluid communication with the sub-compartment in the closed position.

In another aspect of the present disclosure, a refrigerator appliance is provided. The refrigerator appliance may include a cabinet, a fresh food door, a freezer door, a secondary liner, and a heat exchange case. The cabinet may include an internal liner defining a freezer chamber and a fresh food chamber. The fresh food door may be attached to the cabinet to selectively restrict access to the fresh food chamber in a first closed position. The freezer door may be attached to the cabinet at the front end to selectively restrict access to the freezer chamber in a second closed position. The secondary liner may be attached to the cabinet. The secondary liner may define sub-compartment in fluid isolation from the freezer chamber and the fresh food chamber in the first closed position. The heat exchange case may be attached to the internal liner at the freezer chamber in conductive thermal communication therewith. The heat exchange case may at least partially define a convection compartment along a portion of the internal liner to direct heat to the freezer chamber. The convection compartment may be defined in fluid isolation from the freezer chamber and in fluid communication with the sub-compartment in the first closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
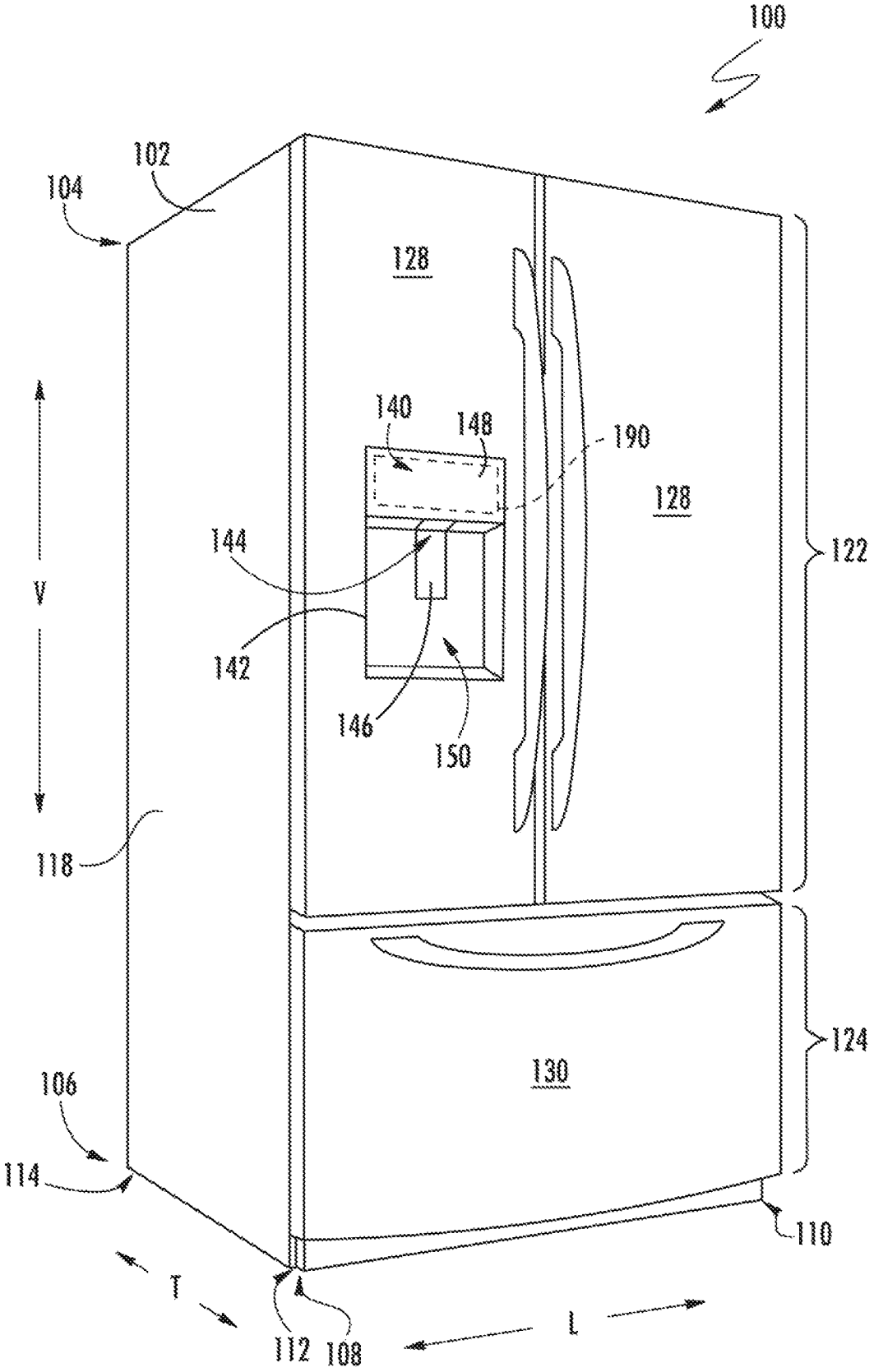
FIG. 1 provides a perspective view of a refrigerator appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, a refrigerator appliance may be provided in some aspects of the present disclosure. The refrigerator appliance can include multiple separate chambers, such as a fresh food chamber and a freezer chamber. An icebox compartment for an icemaker can also be included. For instance, an icebox compartment can be defined in a door that permits access to the fresh food chamber. A separate convection compartment can also be included to exchange chilled air with the icebox compartment. The convection compartment can be formed along a wall of freezer chamber, while still being sealed off from the rest of the freezer chamber. During use, air can be circulated between the convection compartment and the icebox compartment.

Figure 2:
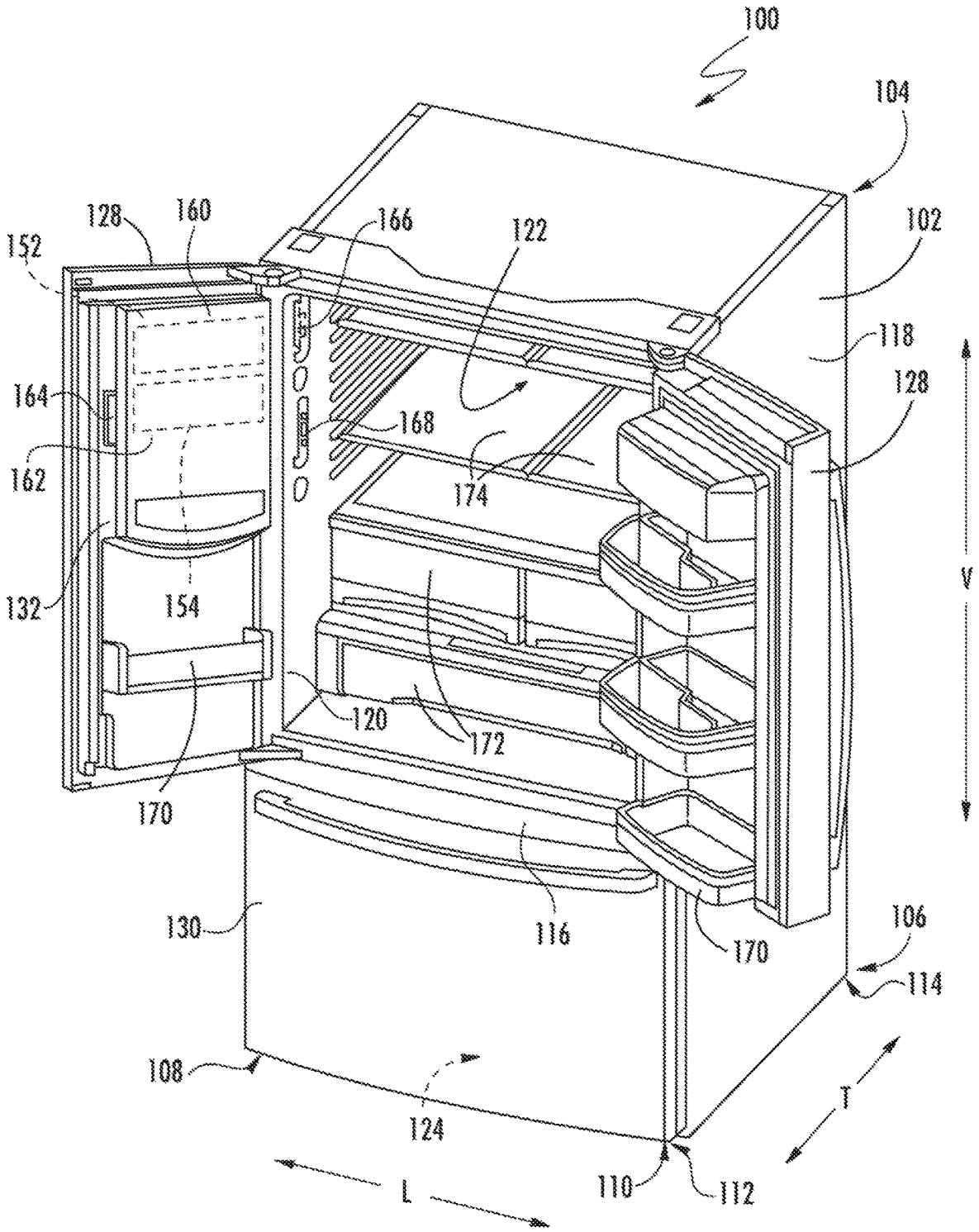
FIG. 2 provides a perspective view of the example refrigerator appliance shown in FIG. 1, wherein a refrigerator door is in an open position according to an example embodiments of the present disclosure.

Turning to the figures, FIGS. 1 and 2 illustrate perspective views of an example appliance (e.g., a refrigerator appliance 100) that includes an ice making feature. Refrigerator appliance 100 includes a housing or cabinet 102 having an outer liner 118. As shown, cabinet generally extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another and form an orthogonal direction system.

As shown, cabinet 102 generally defines chilled chambers for receipt of food items for storage. In particular, cabinet 102 defines fresh food chamber 122 proximal to adjacent top 104 of cabinet 102 and a freezer chamber 124 arranged proximal to 106 of cabinet 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

According to the illustrated embodiment, various storage components are mounted within fresh food chamber 122 to facilitate storage of food items therein as will be understood by those skilled in the art. In particular, the storage components include bins 170, drawers 172, and shelves 174 that are mounted within fresh food chamber 122. Bins 170, drawers 172, and shelves 174 are positioned to receive of food items (e.g., beverages and/or solid food items) and may assist with organizing such food items. As an example, drawers 172 can receive fresh food items (e.g., vegetables, fruits, and/or cheeses) and increase the useful life of such fresh food items. In some embodiments, a lateral mullion 116 is positioned within cabinet 102 and separating freezer chamber 124 and the fresh food chamber 122 along a vertical direction V.

Refrigerator doors 128 are rotatably hinged to an edge of cabinet 102 for selectively accessing fresh food chamber 122 and extending across at least a portion of fresh food chamber 122. In addition, a freezer door 130 is arranged below refrigerator doors 128 for selectively accessing freezer chamber 124 and extending across at least a portion of freezer chamber 124. Freezer door 130 is coupled to a freezer drawer (not shown) slidably mounted within freezer chamber 124. Refrigerator doors 128 and freezer door 130 are each shown in the closed position in FIG. 1 (i.e., a first closed position corresponding to doors 128, and a second closed position corresponding to door 130).

Refrigerator appliance 100 also includes a delivery assembly 140 for delivering or dispensing liquid water and/or ice. Delivery assembly 140 includes a dispenser 142 positioned on or mounted to an exterior portion of refrigerator appliance 100, e.g., on one of refrigerator doors 128. Dispenser 142 includes a discharging outlet 144 for accessing ice and liquid water. An actuating mechanism 146, shown as a paddle, is mounted below discharging outlet 144 for operating dispenser 142. In alternative example embodiments, any suitable actuating mechanism may be used to operate dispenser 142. For example, dispenser 142 can include a sensor (such as an ultrasonic sensor) or a button rather than the paddle. A user interface panel 148 is provided for directing (e.g., selecting) the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128. In example embodiments, dispenser recess 150 is positioned at a level that approximates the chest level of a user. During certain operations, the dispensing assembly 140 may receive ice from an icemaker 152 mounted in a sub-compartment of the fresh food chamber 122, as described below.

Operation of the refrigerator appliance 100 can be generally controlled or regulated by a controller 190. In some embodiments, controller 190 is operably coupled to user interface panel 148 and/or various other components, as will be described below. User interface panel 148 provides selections for user manipulation of the operation of refrigerator appliance 100. As an example, user interface panel 148 may provide for selections between whole or crushed ice, chilled water, and/or specific modes of operation. In response to one or more input signals (e.g., from user manipulation of user interface panel 148 and/or one or more sensor signals), controller 190 may operate various components of the refrigerator appliance 100 according to the current mode of operation.

Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. For certain embodiments, the instructions include a software package configured to operate appliance 100 and, e.g., execute an operation routine including the example method 600 described below with reference to FIG. 17. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 190, or portions thereof, may be positioned in a variety of locations throughout refrigerator appliance 100. In example embodiments, controller 190 is located within the user interface panel 148. In other embodiments, the controller 190 may be positioned at any suitable location within refrigerator appliance 100, such as for example within the fresh food chamber 122, a freezer door 130, etc. Input/output ("I/O") signals may be routed between controller 190 and various operational components of refrigerator appliance 100. For example, user interface panel 148 may be operably coupled to controller 190 via one or more signal lines or shared communication busses.

Figure 6:
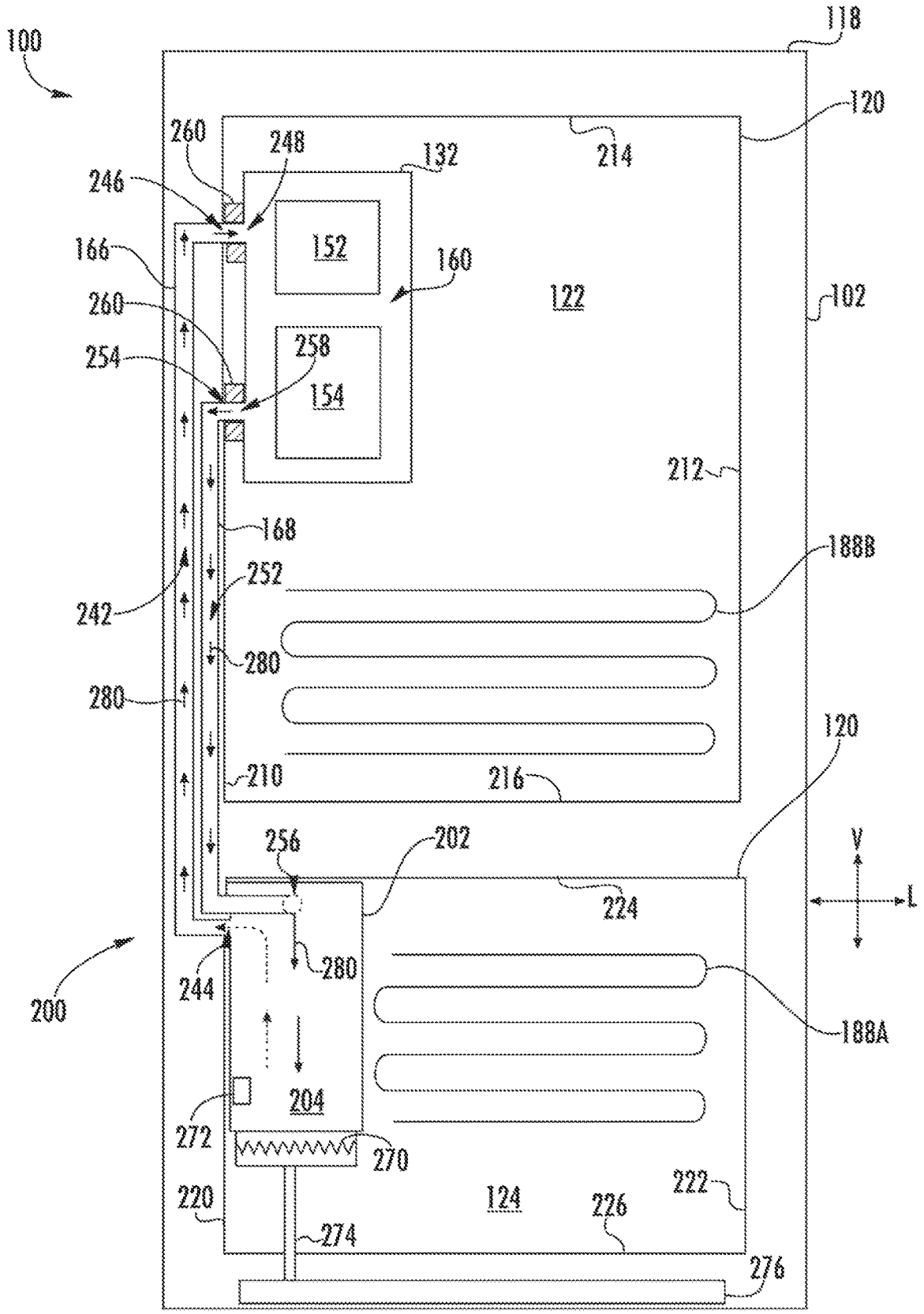
FIG. 6 provides a schematic front view of a refrigerator appliance according to the example embodiments of FIG. 3.

As illustrated, controller 190 may be operably coupled to the various components of dispensing assembly 140 and may control operation of the various components, such as a defrost heater 270 (FIG. 6). For example, the various valves, switches, etc. may be actuatable based on commands from the controller 190. As discussed, interface panel 148 may additionally be operably coupled to the controller 190. Thus, the various operations may occur based on user input or automatically through controller 190 instruction.

FIG. 2 provides a perspective view of refrigerator appliance 100 shown with refrigerator doors 128 in the open position. As shown, an icebox liner 132 defining a sub-compartment (e.g., icebox compartment 160) is attached to cabinet 102. For instance, in some embodiments, at least one door 128 includes icebox liner 132 positioned thereon. In turn, icebox compartment 160 is defined within one of doors 128. In some such embodiments, icebox compartment 160 extends into fresh food chamber 122 when refrigerator door 128 is in the closed position. Although icebox compartment 160 is shown in door 128, additional or alternative embodiments may include an icebox compartment defined at another portion of refrigerator appliance 100 (e.g., within door 130 or fresh food chamber 122). An ice making assembly or icemaker 152 may be positioned or mounted within icebox compartment 160. Ice may be supplied to dispenser recess 150 (FIG. 1) from the icemaker 152 in icebox compartment 160 on a back side of refrigerator door 128.

An access door—e.g., icebox door 162—may be hinged to icebox compartment 160 to selectively cover or permit access to opening of icebox compartment 160. When refrigerator door 128 and icebox door 162 are both closed, icebox door 162 thus seals icebox compartment 160 from fresh food chamber 122. Any manner of suitable latch 164 is provided with icebox compartment 160 to maintain icebox door 162 in a closed position. As an example, latch 164 may be actuated by a consumer in order to open icebox door 162 for providing access into icebox compartment 160. Icebox door 162 can also assist with insulating icebox compartment 160, e.g., by thermally isolating or insulating icebox compartment 160 from fresh food chamber 122. Icebox compartment 160 may receive cooling air from a chilled air supply duct 166 and a chilled air return duct 168 positioned on a side portion of cabinet 102 of refrigerator appliance 100 (e.g., at least partially enclosed between outer liner 118 and internal liner 120). In this manner, the supply duct 166 and return duct 168 may recirculate chilled air from a suitable heat exchange case 202 through icebox compartment 160. An air handler 176 (FIG. 4), such as a fan or blower, may be provided to motivate and recirculate air. As an example, air handler 176 can direct chilled air from a separate compartment through a duct to compartment 160, as will be described below.

In some embodiments, one or more of an icemaker 152 and ice bucket or storage bin 154 are provided within icebox compartment 160. Icemaker 152 may be any suitable assembly for generating ice from liquid water, such as a rigid cube, soft-ice, or nugget ice making assembly. Ice storage bin 154 may be positioned to receive and/or store ice from icemaker 152. Optionally, ice storage bin 154 is positioned below icemaker 152 and receives therefrom. For instance, an ice chute (not pictured) may be positioned adjacent to icemaker 152 to direct ice from icemaker 152 to ice bin 154. From ice storage bin 154, the ice can enter delivery assembly 140 and be accessed by a user.

Figure 3:
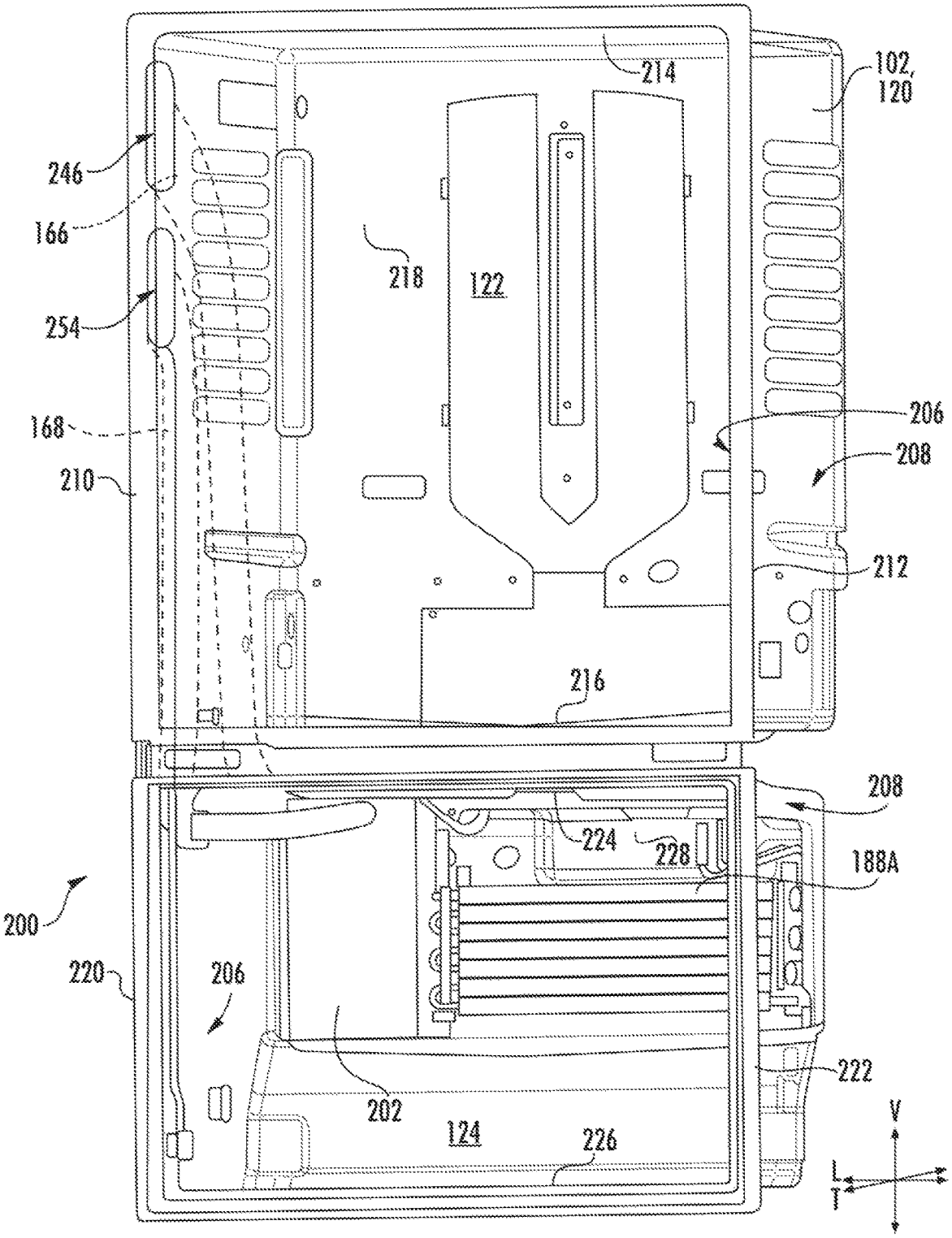
FIG. 3 provides a perspective view of an internal liner and air circulation system of a refrigerator appliance according to example embodiments of the present disclosure.
Figure 4:
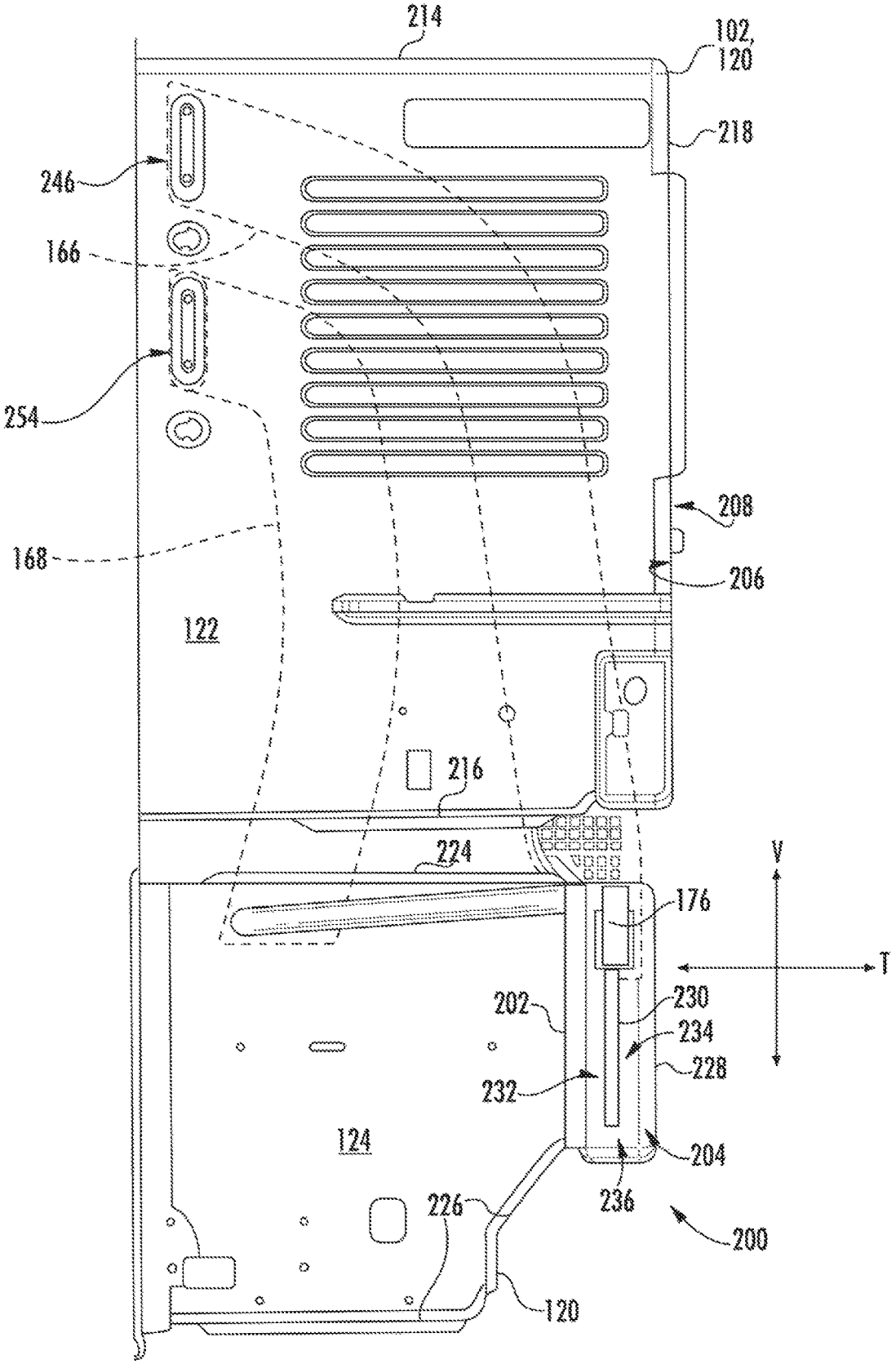
FIG. 4 provides a side view of the internal liner and air circulation system of the example embodiments of FIG. 3.
Figure 5:
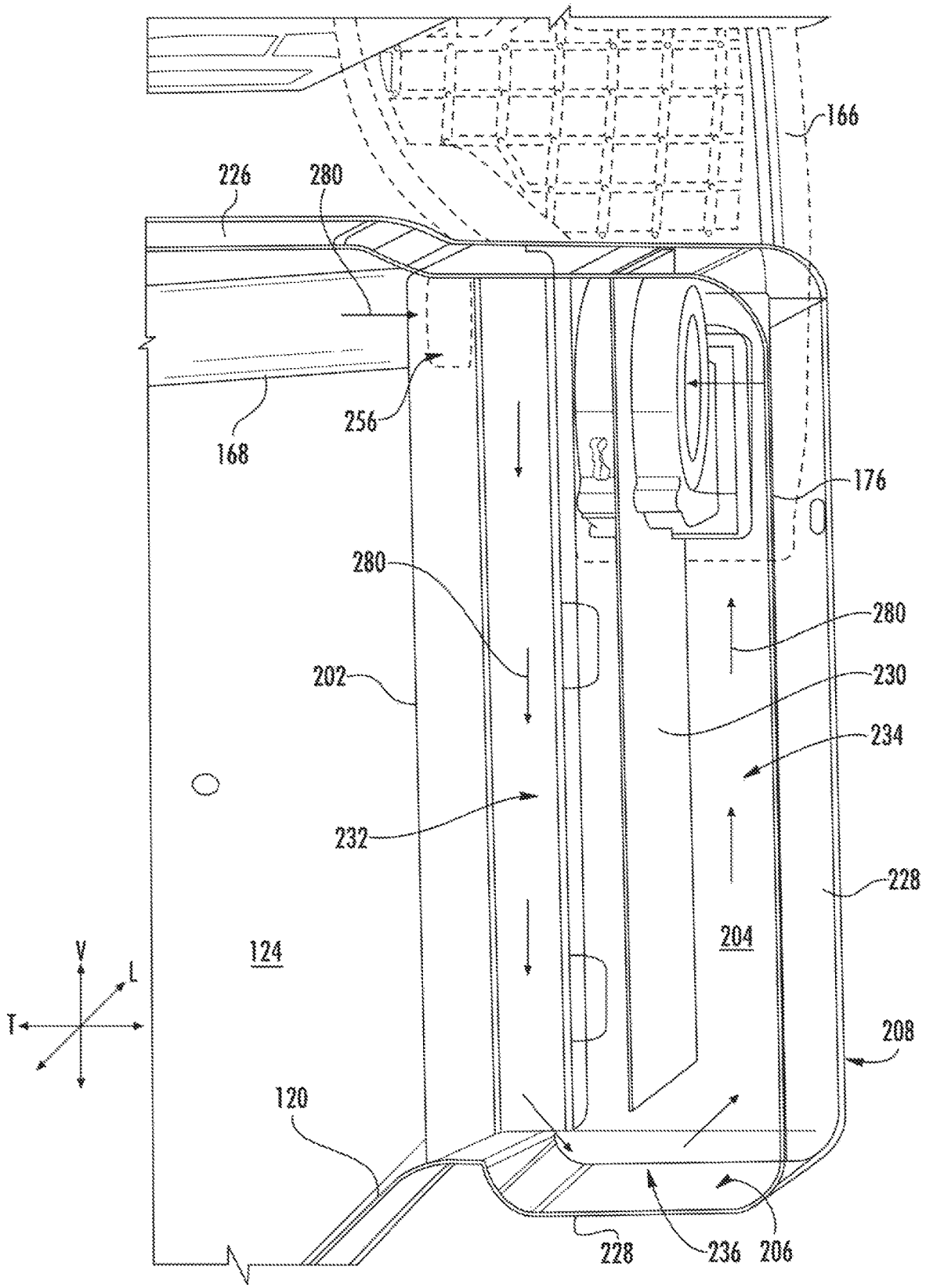
FIG. 5 provides a magnified rear perspective view of a heat exchange case of the example embodiments of FIG. 3.

Turning now to FIGS. 3 through 6, various views of components of refrigerator appliance 100, including an air circulation system 200, are provided. FIGS. 3 and 4 provide a perspective and a side view, respectively, of an internal liner 120 of refrigerator appliance 100. FIG. 5 provides a magnified rear perspective view of a heat exchange case 202 and a defined convection compartment 204. FIG. 6 provides a schematic front view of refrigerator appliance 100, and further illustrates air circulation system 200.

As shown, internal liner 120 generally defines fresh food chamber 122 and/or freezer chamber 124. Specifically, an inner surface 206 of internal liner 120 may define one or both of fresh food chamber 122 and freezer chamber 124. An opposite outer surface 208 of internal liner 120 may face away from inner surface 206 and the respective fresh food chamber 122 or freezer chamber 124.

Internal liner 120 may be formed from a single continuous integral component or, alternatively, from multiple connected pieces. When assembled, fresh food chamber 122 may be fluidly isolated from freezer chamber 124. For instance, both chamber 122, 124 may be isolated such that no air is exchanged between chambers 122, 124 when one or both of doors 128, 130 are closed.

In the illustrated embodiments, internal liner 120 includes a plurality of walls defining chambers 122, 124. Specifically, internal liner 120 includes a first and a second fresh food sidewall (210 and 212) spaced apart along the lateral direction L, as well as an upper and a lower fresh food wall (214 and 216) spaced apart along the vertical direction V. A rear fresh food wall 218 may join upper fresh food wall 214, lower fresh food wall 216, and fresh food sidewalls 210, 212 to define an internal extreme of fresh food chamber 122 along the transverse direction T (i.e., a point or plane of fresh food chamber 122 most proximal to rear side 114 of cabinet 102). Rear fresh food wall 218 may further be positioned opposite an opening defined between the transverse fresh food walls 210, 212, 214, 216 and selectively covered by doors 128. Internal liner 120 may further include a first and a second freezer sidewall (220 and 222) spaced apart along the lateral direction L, as well as an upper and a lower freezer wall (224 and 226) spaced apart along the vertical direction V. A rear freezer wall 228 may join upper freezer wall 224, lower freezer wall 226, and freezer sidewalls 220, 222 to define an internal extreme of freezer chamber 124 along the transverse direction T (i.e., a point or plane of freezer chamber 124 most proximal to rear side 114 of cabinet 102). Rear freezer wall 228 may further be positioned opposite an opening defined between the transverse freezer walls 220, 222, 224, 226 and selectively covered by door 130.

When assembled, internal liner 120 may be assembled at least partially within outer liner 118 (FIG. 1). Insulation (not pictured) may be positioned between internal liner 120 and outer liner 118 along outer surface 208. Additionally or alternatively, insulation may be positioned along outer surface 208 between fresh food chamber 122 and freezer chamber 124.

Figure 7:
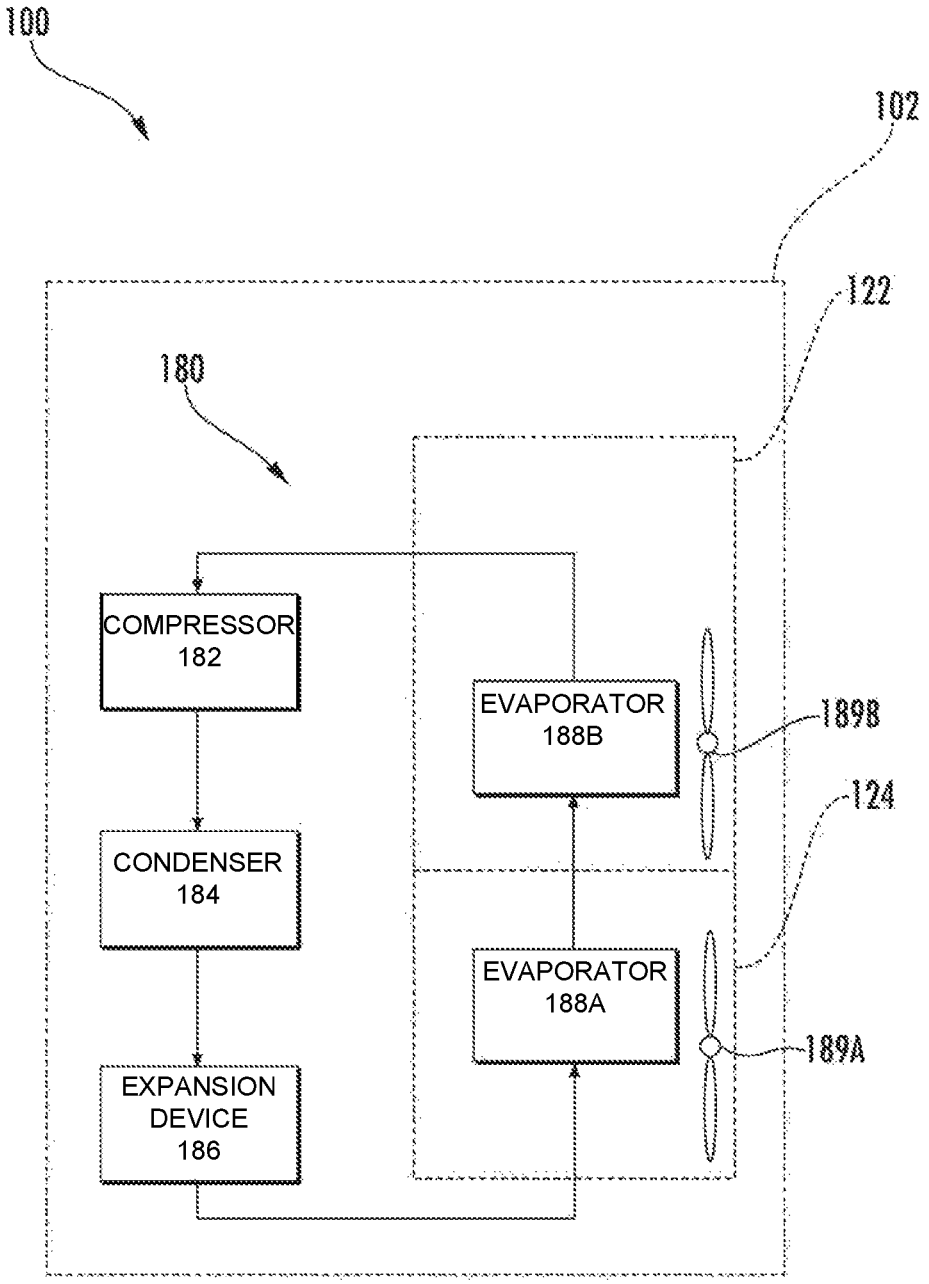
FIG. 7 provides a schematic view of a refrigerator appliance, including a sealed cooling system, according to example embodiments of the present disclosure.

Turning briefly to FIG. 7, a schematic view of certain components of a sealed cooling system 180 for refrigerator appliance 100 is provided. As may be seen in FIG. 7, refrigerator appliance 100 includes a sealed cooling system 180 for executing a vapor compression cycle for cooling air within refrigerator appliance 100, e.g., within fresh food chamber 122 and freezer chamber 124. Sealed cooling system 180 includes a compressor 182, a condenser 184, an expansion device 186, and one or more evaporators 188A, 188B connected in fluid series and charged with a refrigerant. As will be understood by those skilled in the art, sealed cooling system 180 may include additional or fewer components. For example, sealed cooling system 180 may include only a single evaporator (e.g., mounted within fresh food chamber 122 or freezer chamber 124) or multiple discrete evaporators positioned separate locations within cabinet 102.

Within sealed cooling system 180, gaseous refrigerant flows into compressor 182, which operates to increase the pressure of the refrigerant. This compression of the refrigerant raises its temperature, which is lowered by passing the gaseous refrigerant through condenser 184. Within condenser 184, heat exchange (e.g., with ambient air) takes place so as to cool the refrigerant and cause the refrigerant to condense to a liquid state.

Expansion device 186 (e.g., a valve, capillary tube, or other restriction device) receives liquid refrigerant from condenser 184. From expansion device 186, the liquid refrigerant enters evaporator 188A and/or evaporator 188B. In some embodiments, such as the embodiment of FIG. 7, one evaporator 188A is positioned within freezer chamber 124 while another evaporator 188B is positioned within fresh food chamber 122. Upon exiting expansion device 186 and entering evaporator(s) 188A, 188B, the liquid refrigerant drops in pressure and vaporizes. Due to the pressure drop and phase change of the refrigerant, evaporators 188A, 188B are cool relative to freezer and fresh food chambers 124 and 122 of refrigerator appliance 100. As such, cooled air is produced and refrigerates freezer and fresh food chambers 124 and 122 of refrigerator appliance 100. Thus, evaporators 188A, 188B are heat exchangers which transfer heat from air passing over evaporators 188A, 188B to refrigerant flowing through evaporators 188A, 188B. In some embodiments, an air handler 189A or 189B, such as a fan or blower, is provided adjacent to one or more of evaporators 188A, 188B. For instance, air handler 189A may be provided within freezer chamber 124 to motivate air across evaporator 188A. Additionally or alternatively, air handler 189B may be provided within fresh food chamber 122 to motivate air across evaporator 188B.

Figure 8:
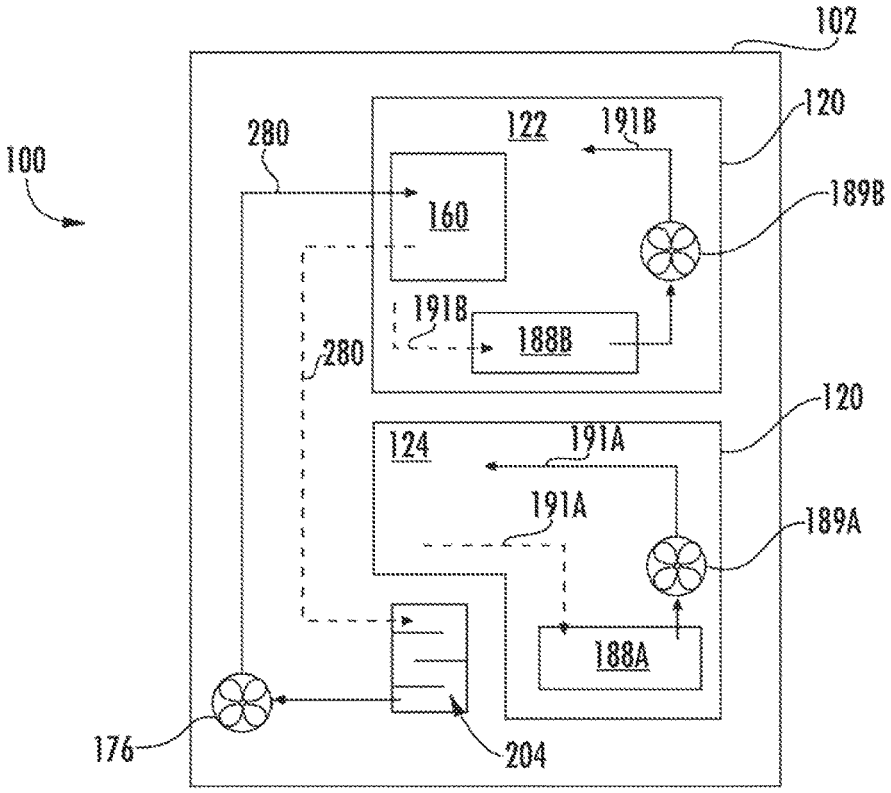
FIG. 8 provides a schematic view of a refrigerator appliance according to example embodiments of the present disclosure.
Figure 9:
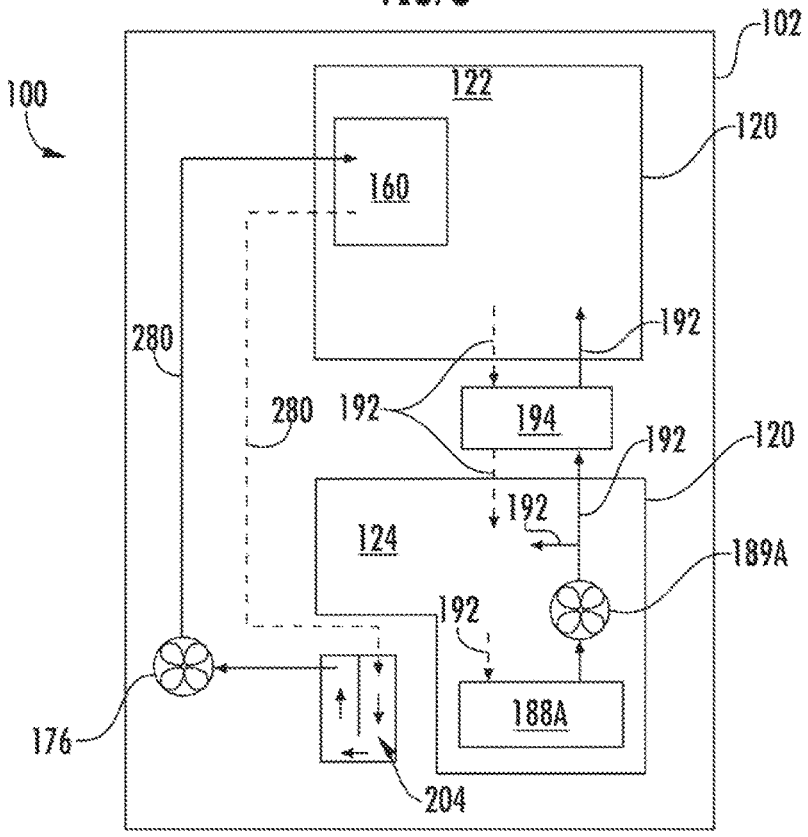
FIG. 9 provides a schematic view of a refrigerator appliance according to example embodiments of the present disclosure.

Turning briefly now to FIGS. 8 and 9, schematic views of certain embodiments of refrigerator appliance 100 are illustrated. Optionally, as shown in FIG. 8, refrigerator appliance 100 may provide freezer chamber 124 in fluid isolation from fresh food chamber 122, e.g., when doors 128 and 130 are in a closed position (FIG. 1). Alternatively, as shown in FIG. 9, refrigerator appliance 100 may provide freezer chamber 124 in fluid communication with fresh food chamber 122, e.g., when doors 128 and 130 are in a closed position (FIG. 1).

As may be seen in FIG. 8, internal liner 120 may define a fluidly isolated freezer chamber 124 and fresh food chamber 122. During operations, air handler 189A may be activated (e.g., rotated as commanded by controller 190—FIG. 1), thereby motivating a freezer airflow (represented by arrows 191A) within a portion of freezer chamber 124. Specifically, the airflow 191A may flow across at least a portion of evaporator 188A, thereby furthering convection heat transfer within freezer chamber 124. Separately or independently, air handler 189B may be activated (e.g., rotated as commanded by controller 190), thereby motivating a fresh food airflow (represented by arrows 191B) within a portion of fresh food chamber 122. Specifically, the airflow 191B may flow across at least a portion of evaporator 188B, thereby furthering convection heat transfer within fresh food chamber 122. Airflows 191A, 191B will thus recirculate apart from each other. As will be described below, another separate airflow (represented by arrows 280) may be selectively motivated (e.g., by air handler 176) between icebox compartment 160 and convection compartment 204.

As may be seen in FIG. 9, internal liner 120 may define a fluidly communicating freezer chamber 124 and fresh food chamber 122. During operations, air handler 189A may be activated (e.g., rotated as commanded by controller 190—FIG. 1), thereby motivating a dual-chamber airflow (represented by arrows 192) within a portion of freezer chamber 124. Specifically, the airflow 192 may flow across at least a portion of evaporator 188A, thereby furthering convection heat transfer within freezer chamber 124. Moreover, the airflow 192 may further be directed to a portion of fresh food chamber 122. Specifically, the airflow 192 may be selectively permitted or restricted through a flow control device 194 (e.g., air damper or valve) in fluid communication between freezer chamber 124 and fresh food chamber 122. Optionally, at least a portion of the airflow 192 may be circulated within freezer chamber 124 without passing to fresh food chamber 122. Additionally or alternatively, flow control device 194 may be selectively opened and closed (e.g., as commanded by controller 190) based on cooling demands within freezer chamber 124 and fresh food chamber 122. The airflow 192 may thus be selectively circulated from freezer chamber 124 to fresh food chamber 122 and vice versa. As will be described below, another separate airflow (e.g., represented by arrows 280) may be selectively motivated (e.g., by air handler 176) between icebox compartment 160 and convection compartment 204.

Returning to FIGS. 3 through 6, a heat exchange case 202 is provided on a portion of internal liner 120. Specifically, heat exchange case 202 is positioned or mounted along a portion of internal liner 120 at the freezer chamber 124. When assembled, heat exchange case 202 at least partially defines a convection compartment 204. As shown, the internal liner 120 (e.g., the portion of internal liner 120 along which heat exchange case 202 is positioned) may further define convection compartment 204. In some such embodiments, heat exchange case 202 is positioned within or enclosed by freezer chamber 124. In turn, a portion of inner surface 206 defines convection compartment 204 with heat exchange case 202.

Generally, convection compartment 204 is provided in fluid isolation from freezer chamber 124. In other words, air is not readily exchanged between convection compartment 204 and freezer chamber 124 (e.g., the surrounding portion of freezer chamber 124). For instance, heat exchange case 202 may be provided as a solid member lacking any door or open passage in fluid communication with freezer chamber 124 and/or fresh food chamber 122. Nonetheless, heat exchange case 202 may be conductive thermal communication with internal liner 120 at freezer chamber 124. Although convection compartment 204 is illustrated as a generally open cavity in FIGS. 3 through 6, alternative embodiments may include one or more fin members (e.g., attached to or formed on heat exchange case 202 and/or internal liner 120) extending into convection compartment 204, thereby increasing the surface area within convection compartment 204.

During use, heat may transfer between convection compartment 204 and freezer chamber 124 during operations of appliance 100, e.g., through internal liner 120. Specifically, heat may be conducted from convection compartment 204 and through internal liner 120 before being absorbed within the relatively cool environment of freezer chamber 124. In turn, convection may further serve to draw heat from the affected portions of internal liner 120. In some embodiments, heat may additionally be conducted from convection compartment 204 through heat exchange case 202 and absorbed within freezer chamber 124. Optionally, an evaporator (e.g., evaporator 188A) may be mounted adjacent to heat exchange case 202 outside of convection compartment 204 to further promote heat transfer from convection compartment 204. Advantageously, the sealed convection compartment 204 may prevent or reduce significant temperature variations or gradients within freezer chamber 124 without requiring additional active cooling components, such as an evaporator, within the convection compartment 204.

In turn, convection compartment 204 may be an evaporator-free compartment. Specifically, no evaporator (or other isolated refrigerant-flowing component, such as a condenser) of a sealed or unsealed refrigeration system is provided within convection compartment 204. Icebox compartment 160 and/or air passages 242, 252 may further be evaporator-free such that the air path defined through air circulation system 200 does not include any evaporator or otherwise active refrigeration component. In turn, air flowed between convection compartment 204 and icebox compartment 160 may be recirculated without directly flowing over or across an evaporator or other isolated refrigerant-flowing component.

Advantageously, assembly and operation of air circulation system 200 may be relatively easy, quick, and cost effective while providing efficient and effective cooling therethrough.

In some embodiments, an air handler 176 is provided in fluid communication between convection compartment 204 and icebox compartment 160 to motivate air between icebox compartment 176 and convection compartment 204. Air handler 176 may be operably coupled (e.g., electrically coupled) to controller 190 (FIG. 1). In turn, controller 190 may be configured to activate or otherwise operate air handler 176 as desired. In optional embodiments, the performance of air handler 176 (e.g., the speed of rotation or volumetric flow rate at which air handler 176 motivates air therethrough) is operatively linked to operation of icemaker 152. For instance, the rate at which icemaker 152 produces ice (e.g., mass of ice produced per day) may correspond to performance of air handler 176. Either component 176, 154 may be a variable component. In some such embodiments, the ice production rate of icemaker 152 may be selectively varied according to the performance of air handler 176. As an example, icemaker 152 may produce a relatively high mass of ice per day when air handler 176 operates at a first speed and another relatively low mass of ice per day when air handler operates at a second speed that is lower than the first speed.

Although convection compartment 204 generally provides an open void through which air may flow, convection compartment 204 may be defined as a non-linear airflow path. For instance, at least a portion of the convection compartment 204 within heat exchange case 202 between return outlet 256 and supply inlet 244 may be non-linear such that air 280 passing therethrough is redirected one or more times. In some such embodiments, one or more air-guiding components may be included. For instance, a partition wall 230 may extend within convection compartment 204 at a position between the heat exchange case 202 and the portion of the internal liner 120 defining convection compartment 204. In certain embodiments, partition wall 230 extends downward along the vertical direction V from a top portion of convection compartment 204. Partition wall 230 may thus separate convection compartment 204 into a forward cavity 232 and a rearward cavity 234. A flow channel 236 may be defined between forward cavity 232 and rearward cavity 234, e.g., as a vertical gap between partition wall 230 and a bottom portion of convection compartment 204.

In additional or alternative embodiments, an air handler 176 may be provided within convection compartment 204. For instance, air handler 176 may be mounted on partition wall 230 and/or against a portion of internal liner 120. Advantageously, such mounting may advantageously absorb or reduce vibrations and noise generated by air handler 176 during operations. Nonetheless, alternative embodiments may include air handler at another suitable position that is outside of the convection chamber 204, but otherwise in fluid communication therewith.

As shown, convection compartment 204 may be generally provided in fluid communication with icebox compartment 160. Specifically, a separate air supply duct 166 and air return duct 168 are provided in fluid communication between convection compartment 204 and icebox compartment 160. Air supply duct 166 defines a supply passage 242 that extends vertically between a supply inlet 244 and a supply outlet 246. When assembled, the supply outlet 246 is positioned above supply inlet 244, e.g., proximal to icebox liner 132. Air return duct 168 defines a return passage 252 that extends vertically between a return inlet 254 and a return outlet 256. When assembled, return inlet 254 is positioned above return outlet 256, e.g., proximal icebox liner 132. Optionally, return inlet 254 may be further positioned below supply outlet 246. Additionally or alternatively, the return outlet 256 and supply inlet 244 are defined at the convection compartment 204 forward from the rear freezer wall 228 along the transverse direction T.

In order to exchange air with ducts 166, 168, icebox liner 132 defines an icebox inlet 248 in downstream communication with supply outlet 246, as well as a separate icebox outlet in upstream communication with return inlet 254. In some embodiments, one or more gaskets 260 may be provided between icebox inlet 248 and supply outlet 246, as well as between icebox outlet 258 and return inlet 254. In other words, gasket(s) 260 may be provided at a mating surface of icebox liner 132 and internal liner 120 to sealingly engage the other. For instance, when the door 128 is in a closed position, a gasket 260 may sealingly engage a first fresh food sidewall 210 with icebox liner 132 to prevent air leakage. In turn, gaskets 260 may help to prevent or minimize cold air flowing between supply duct 166 and return duct 168 from escaping into the fresh food chamber 122 and/or relatively warm, humid air from fresh food chamber 122 from entering return duct 168.

During operations, and when door 128 is in the closed position, air may be directly recirculated between icebox compartment 160 and convection compartment 204 (as indicated by arrows 280). For instance, air handler 176 may motivate relatively low-temperature air from the rearward cavity 234 of convection compartment 204 into air supply duct 166 through supply inlet 244. Air within supply duct 166 may travel through supply passage 242 before flowing directly from supply outlet 246 to icebox inlet 248 and into icebox compartment 160. Within icebox compartment 160, air may then flow, e.g., downward along the vertical direction V, across icemaker 152 and storage bin 154. Thus, air may absorb heat within icebox compartment 160, e.g., through convection, before flowing through icebox outlet 258 and return inlet 254 below storage bin 154. Air may subsequently flow through return passage 252 before flowing through convection compartment 204. Within convection compartment 204, air may flow successively through forward cavity 232 and flow channel 236 before returning to rearward cavity 234.

Over time, or in response to extended cooling operations, frost may form on certain portions of heat exchange case 202 and/or within convection compartment 204. In some embodiments, a defrost heater 270 may be utilized to defrost convection compartment 204, e.g., to melt ice that accumulates on heat exchange case 202 and/or within convection compartment 204. Defrost heater 270 may be any suitable heater, such as an electrical resistive heater, radiant heater, etc. Moreover, defrost heater 270 may be positioned adjacent or in close proximity to (e.g., below) convection compartment 204 within or adjacent freezer chamber 124. In certain modes of operation, defrost heater 270 may be activated periodically; that is, a period of time $t_{ice}$ elapses between when defrost heater 270 is deactivated and when defrost heater 270 is reactivated to melt a new accumulation of ice at convection compartment 204. The period of time $t_{ice}$ may be a preprogrammed period such that time $t_{ice}$ is the same between each period of activation of defrost heater 270, or the period of time may vary. Additionally or alternatively, in certain modes of operation defrost heater 270 may be activated based on some other condition, such as the temperature of convection compartment 204 or any other appropriate condition.

In some embodiments, a defrost termination thermostat 272 may be used to monitor the temperature of convection compartment 204 such that defrost heater 270 is deactivated when thermostat 272 measures that the temperature of convection compartment 204 is above a set temperature, i.e., greater than thirty-two degrees Fahrenheit (32° F.). In some embodiments, thermostat 272 may send a signal to controller 190 (FIG. 1) or other suitable device to deactivate defrost heater 270 when convection compartment 204 is above the set temperature. In other embodiments, defrost termination thermostat 272 may comprise a switch such that defrost heater 270 is switched off when thermostat 272 measures that the temperature of convection compartment 204 is above the set temperature.

In certain embodiments, a drain line 274 is disposed below heat exchange case 202. For instance, drain line 274 may be positioned adjacent heat exchange case 202 and be configured for directing liquid from, for example, an outer portion of heat exchange case 202. Optionally, an evaporator pan 276 may be positioned within cabinet 102. In some such embodiments, drain line 274 extends between and fluidly connects an outer portion of heat exchange case 202 and evaporator pan 276. In particular, drain line 274 directs liquid runoff from heat exchange case 202 to evaporator pan 276, e.g., during a defrost cycle of defrost heater 270. Within evaporator pan 276, such liquid can evaporate.

As will be understood by those skilled in the art, evaporator pan 276 can also receive liquid runoff from one or more of the evaporator(s) of refrigerator appliance 100, e.g., during another defrost cycle of refrigerator appliance 100. However, in alternative exemplary embodiments, evaporator pan 276 can be a separate component such that runoff from heat exchange case 202 and the evaporator(s) of refrigerator appliance 100 are directed to separate pans. In additional or alternative embodiments, drain line 274 can be directed to a drain of a plumbing system (not shown), e.g., within a residence housing refrigerator appliance 100, such that run off is directed into the plumbing system rather than evaporating within refrigerator appliance 100.

Figure 10:
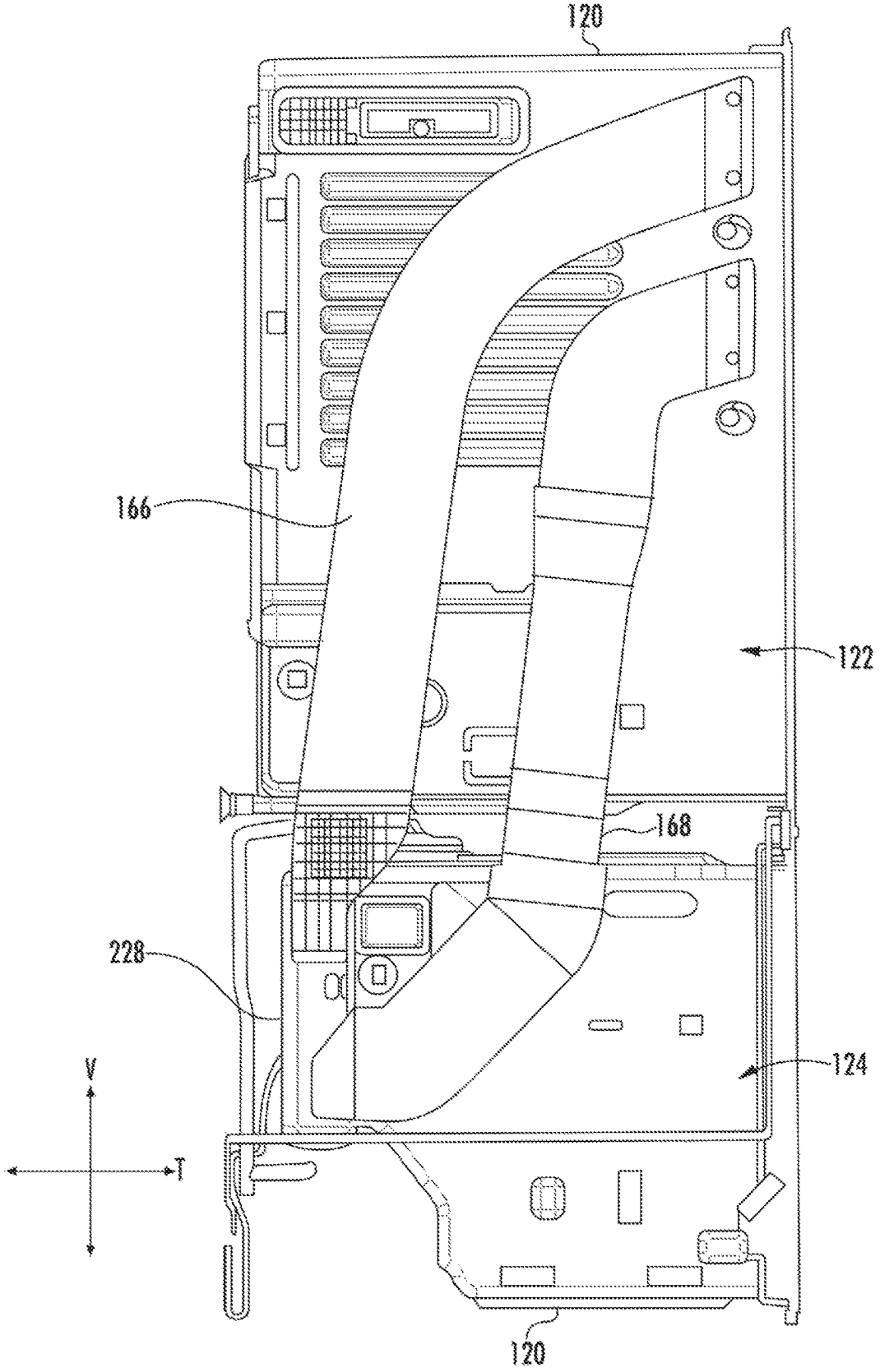
FIG. 10 provides a side view of an internal liner and air circulation system of a refrigerator appliance according to example embodiments of the present disclosure.
Figure 11:
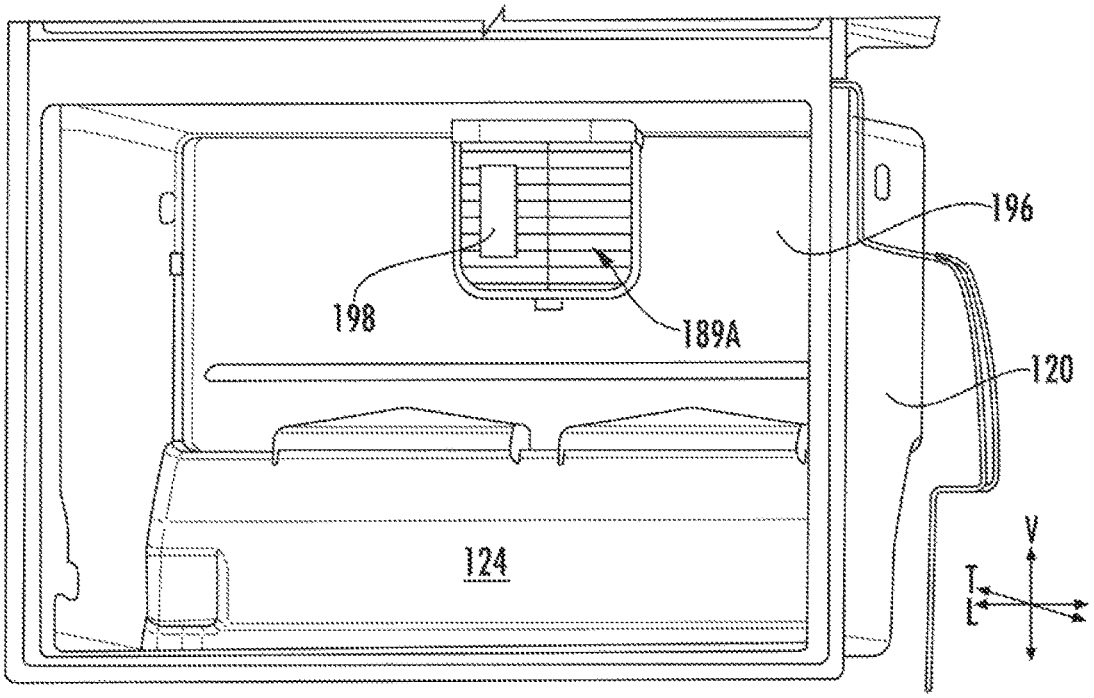
FIG. 11 provides a magnified front perspective view of a portion of the example embodiments of FIG. 10.
Figure 12:
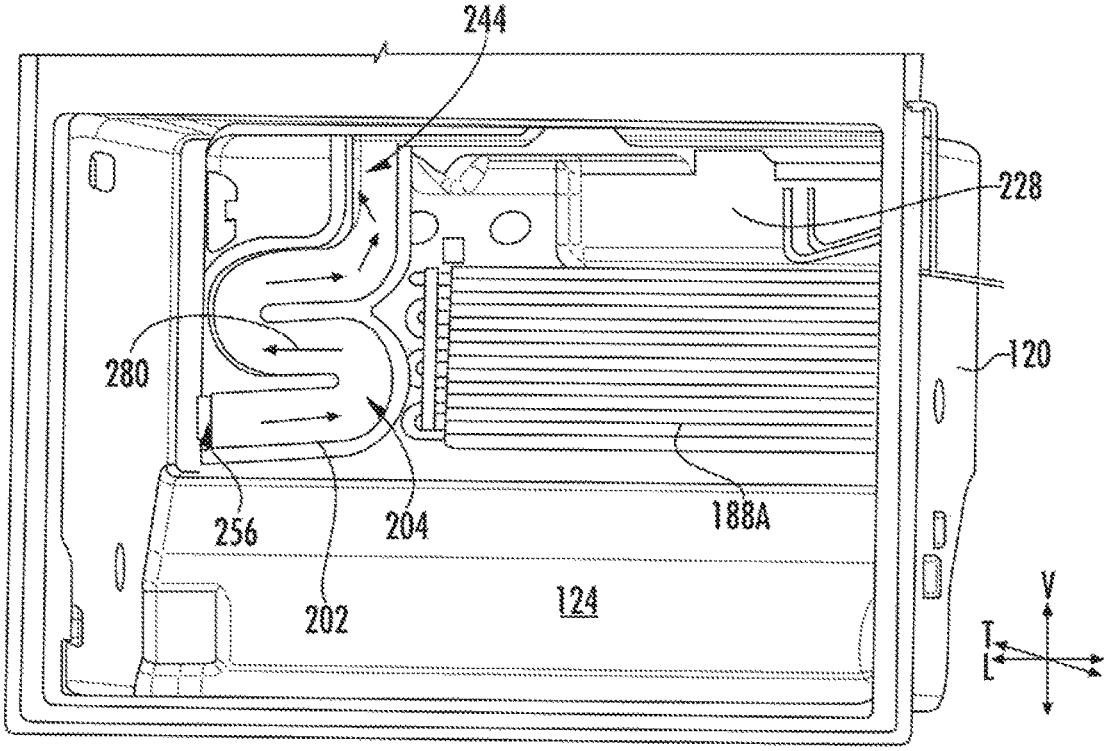
FIG. 12 provides a magnified front perspective view of a portion of the example embodiments of FIG. 11, wherein an evaporator cover has been removed for illustration of further features of the refrigerator appliance.

Turning briefly to FIGS. 10 through 12, various views of further example embodiments of refrigerator appliance 100 including an internal liner 120 and alternative embodiments of air circulation system 200. Except as otherwise indicated, it is understood that the embodiments of FIGS. 10 through 12, are substantially similar to the embodiments described above with respect to FIGS. 1 through 9. In turn, the same numerals are generally used throughout. Moreover, it is also understood that the embodiments of FIGS. 10 through 12 could be modified to include features of the embodiments of FIGS. 1 through 9, and vice versa, except as otherwise indicated.

As shown, some embodiments of internal liner 120 may hold heat exchange case 202 at a rear portion thereof. For instance, heat exchange case 202 may be attached to internal liner 120 adjacent to evaporator 188A within a portion of freezer chamber 124. In specific embodiments, heat exchange case 202 and evaporator 188A may be housed between an evaporator cover 196 of internal liner 120 and another portion of internal liner 120 (e.g., rear wall 228). Optionally, evaporator cover 196 may substantially enclose heat exchange case 202 and evaporator 188A separate from the rest of freezer chamber 124, while still permitting fluid communication therebetween. Additionally or alternatively, a portion of evaporator cover 196 may further define a portion of convection compartment 204 with heat exchange case 202, while another portion of evaporator cover 196 extends outside of convection compartment 204 (e.g., across evaporator 188A). Heat within convection compartment 204 may thus be advantageously conducted away from heat exchange case 202 and outside of convection compartment 204.

In some embodiments, air handler 189A is provided to circulate air within freezer chamber 124. For instance, air handler 189A may be mounted on evaporator cover 196 to motivate air across evaporator 188A and/or heat exchange case 202 (e.g., outside of and separate from convection compartment 204). In certain embodiments, a diverter plate 198 is mounted adjacent to air handler 189A to guide airflow therefrom. Specifically, diverter plate 198 may guide airflow in the direction of heat exchange case 202. Air handler 189A may thus operate to direct a freezer airflow toward convection compartment 204 (e.g., without passing any air into convection compartment). Convective heat exchange with convection compartment 204 may thus be advantageously promoted or accelerated without exchanging any air between freezer chamber 204 and convection compartment 204.

As shown, particularly in FIG. 12, some embodiments of convection compartment 204 are defined as a non-linear airflow path for air 280 (e.g., between return outlet 256 and supply inlet 244). For instance, convection compartment 204 may be defined as a serpentine path having multiple passes wherein air 280 is redirected (e.g., laterally) within heat exchange case 280. Additionally or alternatively, convection compartment 204 may generally direct air 280 vertically. In turn, return outlet 256 may be defined below supply inlet 244 along the vertical direction V.

Advantageously, embodiments of convection compartment 204 may promote greater heat exchange while providing a relatively low pressure drop therethrough. In turn, airflow through air circulation system may be efficiently motivated to effectively cool, e.g., icebox compartment 160 (FIG. 6).

Turning now to FIGS. 13 through 16, various alternative example embodiments of refrigerator appliance 100 may be provided. Except as otherwise indicated, it is understood that the embodiments of FIGS. 13 through 16 are substantially similar to the embodiments described above with respect to FIGS. 1 through 12. In turn, the same numerals are generally used throughout. Moreover, it is also understood that the embodiments of FIGS. 13 through 16 could be modified to include features of the embodiments of FIGS. 1 through 12, and vice versa, except as otherwise indicated.

Figure 13:
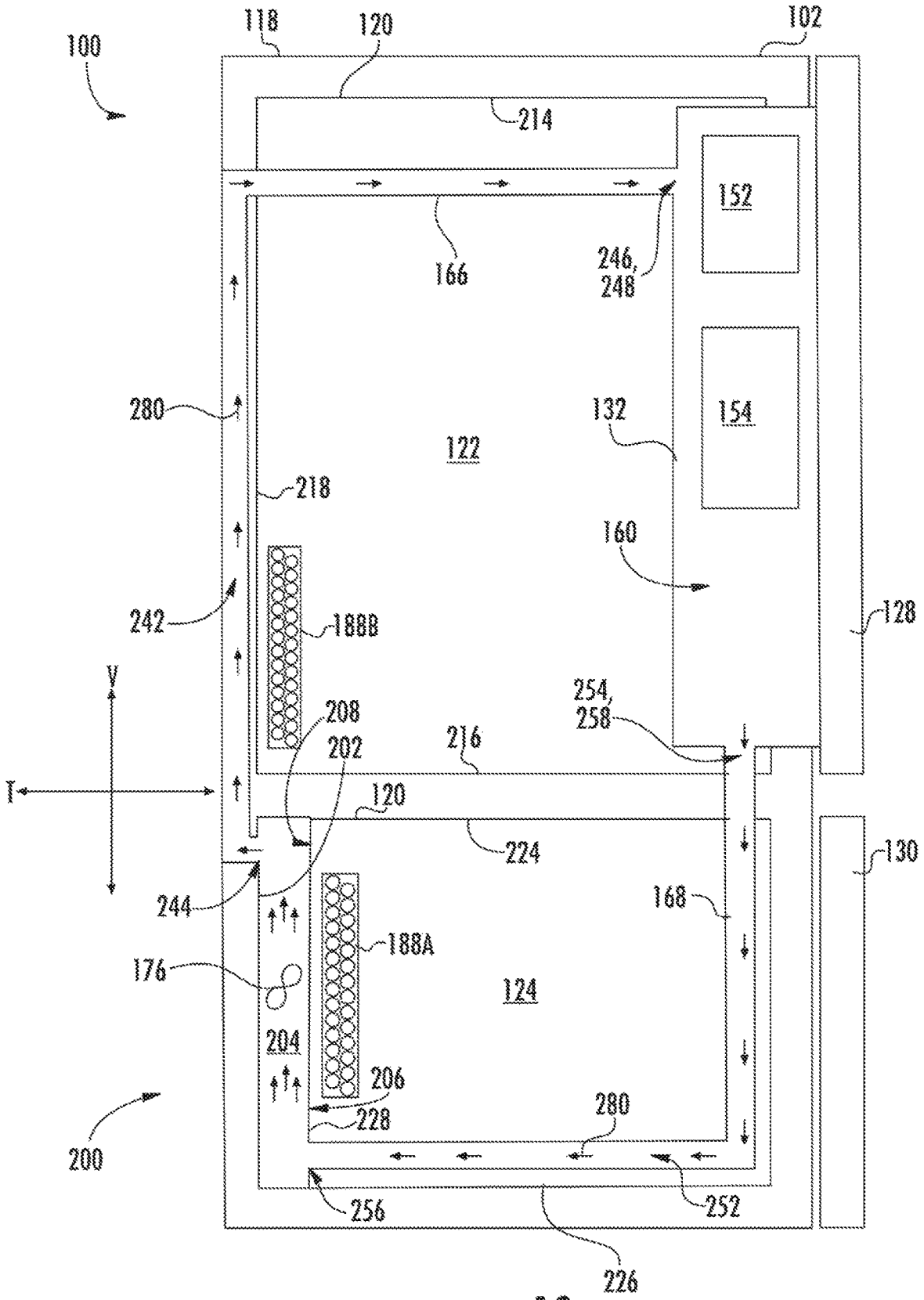
FIG. 13 provides a schematic side view of a refrigerator appliance according to example embodiments of the present disclosure.

As shown in the schematic view of FIG. 13, certain embodiments of refrigerator appliance 100 include a heat exchange case 202 positioned on rear freezer wall 228 outside of freezer chamber 124. In other words, heat exchange case 202 is mounted to a portion of outer surface 208 of rear freezer wall 228. As shown, heat exchange case 202 and internal liner 120 define convection compartment 204 rearward or directly behind evaporator 188A along the transverse direction T. Supply inlet 244 is defined above return outlet 256 along the vertical direction V. One or both of chilled air ducts 166, 168 may be directed around a lateral perimeter of internal liner 120 within outer liner 118. Supply outlet 246 and icebox inlet 248 are defined above icebox outlet 258 and return inlet 254.

Figure 14:
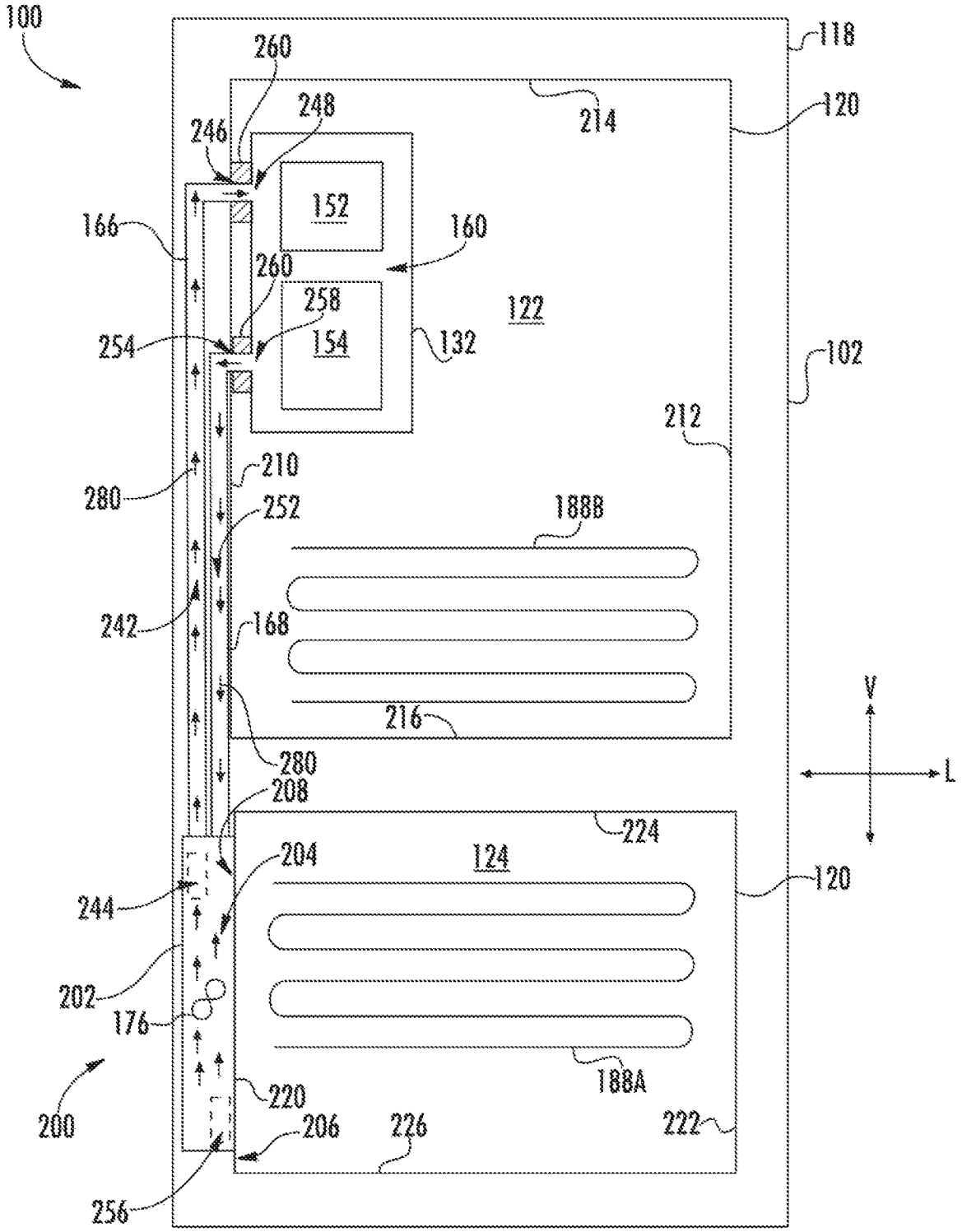
FIG. 14 provides a schematic front view of a refrigerator appliance according to example embodiments of the present disclosure.

As shown in the schematic view of FIG. 14, further embodiments of refrigerator appliance 100 include heat exchange case 202 positioned on first freezer sidewall 220 outside of the freezer chamber 124. In other words, heat exchange case 202 is mounted to a portion of outer surface 208 of first freezer sidewall 220. As shown, heat exchange case 202 and internal liner 120 define convection compartment 204 laterally spaced from evaporator 188A. Supply inlet 244 is defined above return outlet 256 along the vertical direction V. One or both of chilled air ducts 166, 168 may be directed around a lateral perimeter of internal liner 120 within outer liner 118. Supply outlet 246 and icebox inlet 248 are defined above icebox outlet 258 and return inlet 254.

Figure 15:
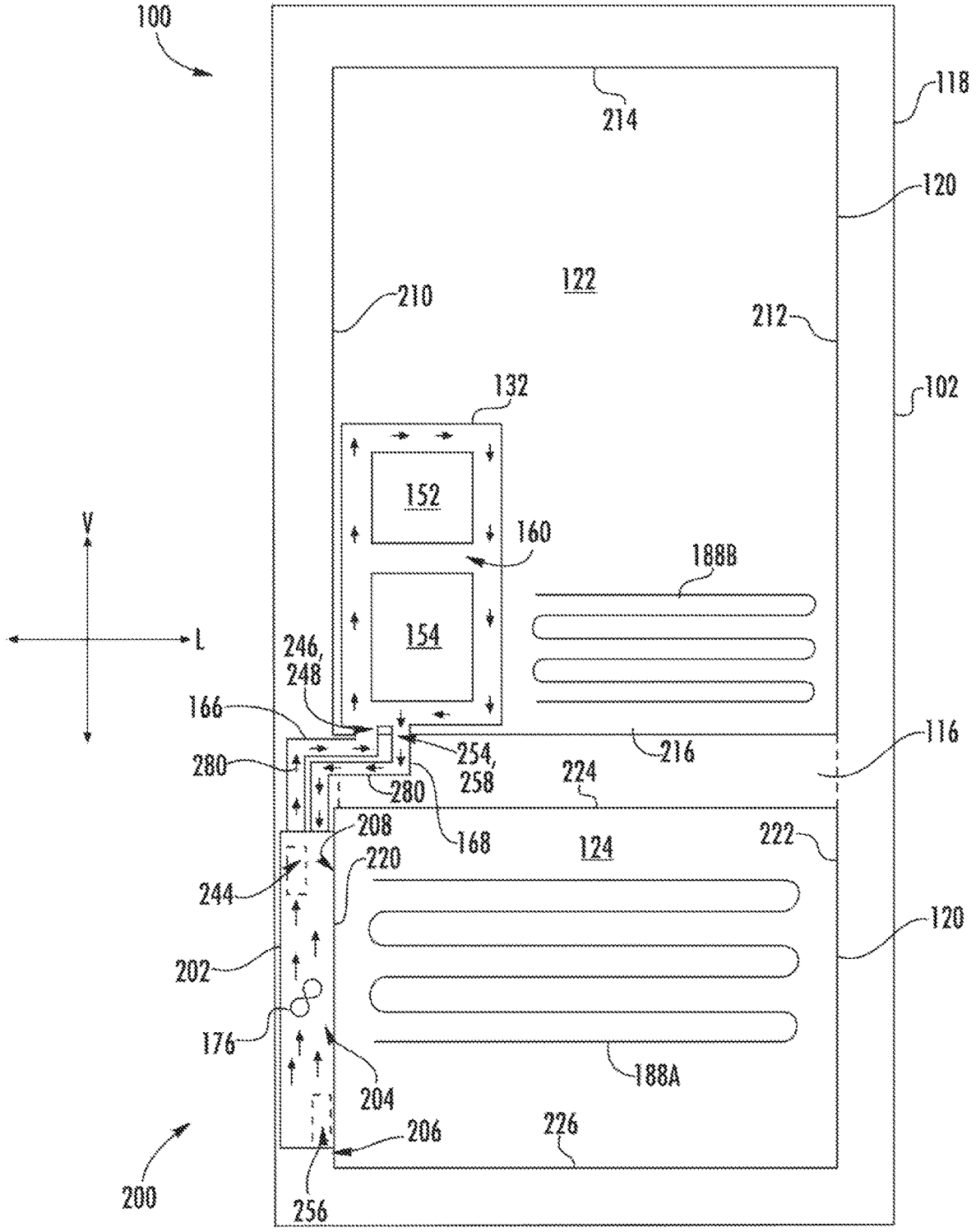
FIG. 15 provides a schematic side view of a refrigerator appliance according to example embodiments of the present disclosure.

As shown in the schematic view of FIG. 15, still further embodiments of refrigerator appliance 100 include heat exchange case 202 positioned on first freezer sidewall 220 outside of the freezer chamber 124. In other words, heat exchange case 202 is mounted to a portion of outer surface 208 of first freezer sidewall 220. As shown, heat exchange case 202 and internal liner 120 define convection compartment 204 laterally spaced from evaporator 188A. Supply inlet 244 is defined above return outlet 256 along the vertical direction V. Both chilled air ducts 166, 168 are directed around internal liner 120 within outer liner 118. Moreover, both chilled air ducts 166, 168 are directed through lateral mullion 116 and lower fresh food wall 216. Supply outlet 246 and icebox inlet 248 are defined parallel to icebox outlet 258 and return inlet 254 along the vertical direction V. An interior duct provided within icebox compartment 160 directs air upward along a portion of storage bin 154 and icemaker 152 from icebox inlet 248 before the air is directed downward along another portion of portion of icemaker 152 and storage bin 154.

Figure 16:
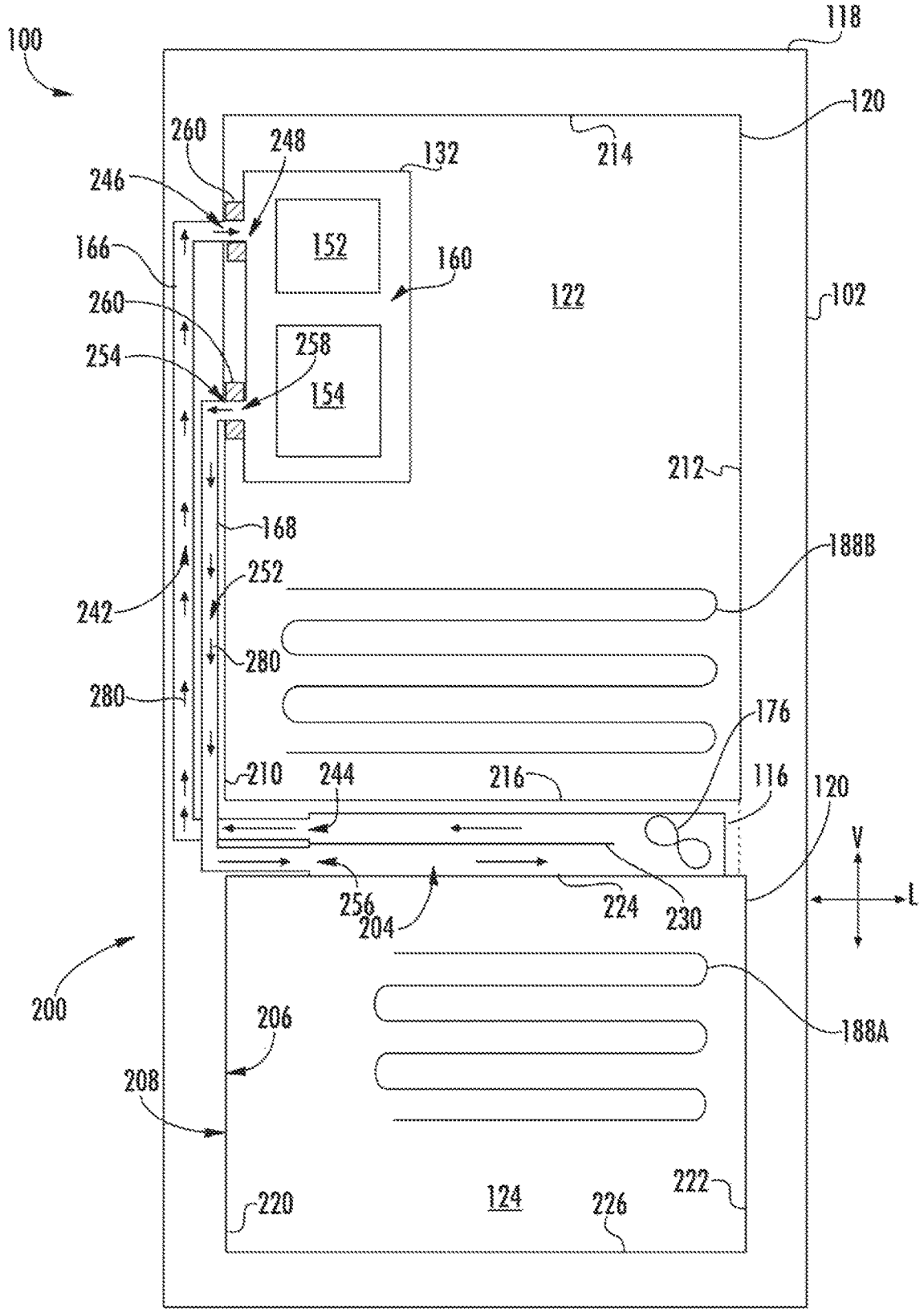
FIG. 16 provides a schematic side view of a refrigerator appliance according to example embodiments of the present disclosure.

As shown in the schematic view of FIG. 16, still further embodiments of refrigerator appliance 100 include heat exchange case 202 positioned on upper wall 224 outside of the freezer chamber 124. In other words, heat exchange case 202 is mounted to a portion of outer surface 208 of upper wall 224 between freezer chamber 124 and fresh food chamber 122. Optionally, heat exchange case 202 may be positioned within mullion 116. As shown, heat exchange case 202 and internal liner 120 define convection compartment 204 vertically spaced from (e.g., above) evaporator 188A. Supply inlet 244 is defined above return outlet 256 along the vertical direction V. A partition wall 230 may extend (e.g., laterally) within convection compartment 204. In turn, partition wall 230 may thus separate convection compartment 204 into a lower cavity downstream from supply inlet 244 and an upper cavity downstream from the lower cavity and upstream from return outlet 256. In some such embodiments, air handler 176 is mounted within convection compartment 204 between the lower and upper cavities. Alternatively, air handler 176 may be mounted within one of chilled air ducts 166, 168 or icebox compartment 160. One or both of chilled air ducts 166, 168 may be directed around a lateral perimeter of internal liner 120 within outer liner 118. Supply outlet 246 and icebox inlet 248 are defined above icebox outlet 258 and return inlet 254.

Figure 17:
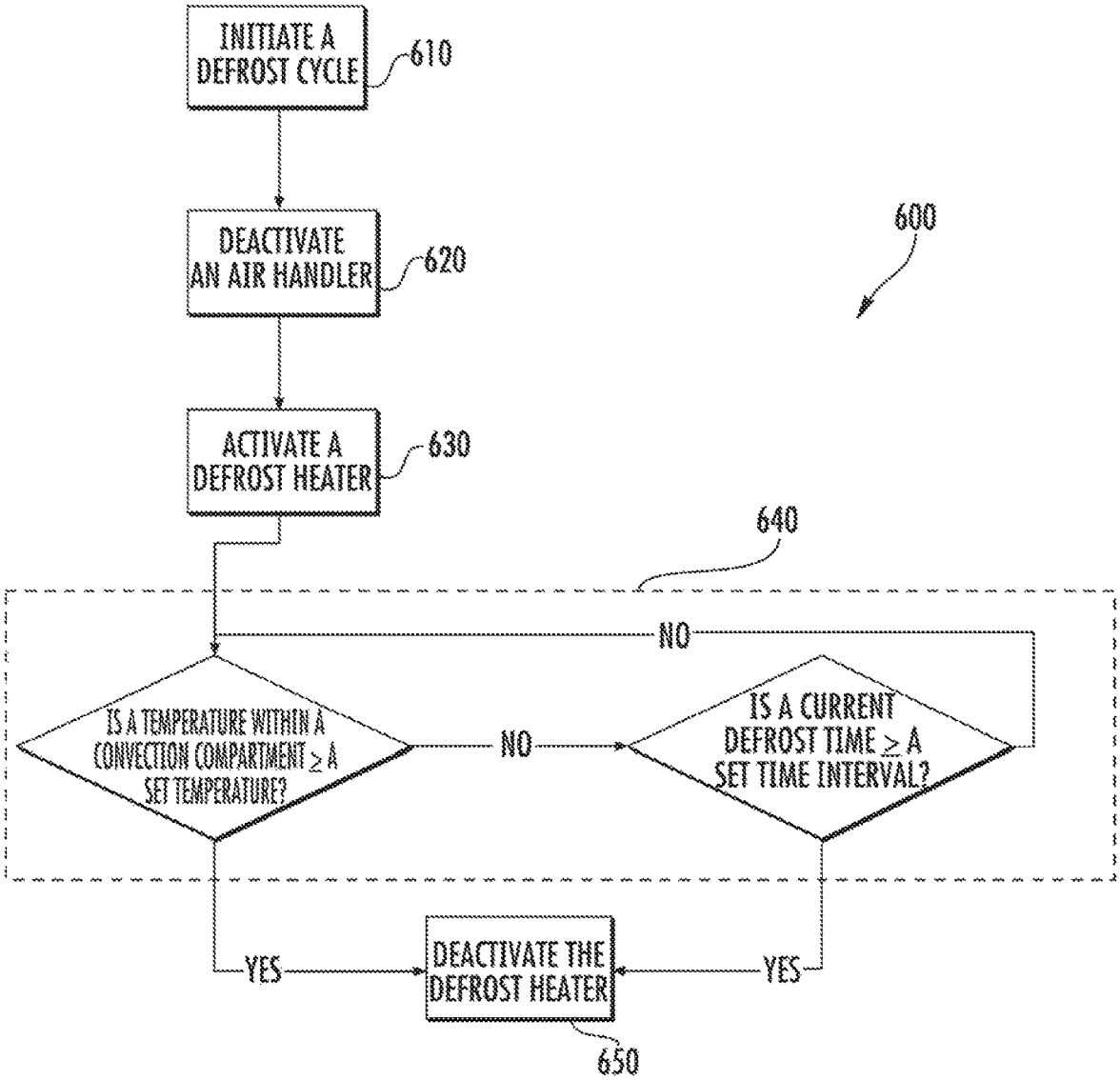
FIG. 17 provides a flow chart illustrating a method of operating a refrigerator appliance in accordance with example embodiments of the present disclosure.

Turning now to FIG. 17, a flow chart is provided of a method 600 according to example embodiments of the present disclosure. Generally, the method 600 provides for methods of operating a refrigeration appliance 100 (FIG. 1) that includes a cabinet 120, doors 128 and/or 130, and convection compartment 204 (e.g., FIGS. 1 and 6), as described above. The method 600 can be performed, for instance, by the controller 190 (FIG. 1). For example, controller 190 may, as discussed, be operably coupled to air handler 176, defrost heater 270, thermostat 272, and user interface panel 148 (e.g., FIGS. 1 and 6). During operations, controller 190 may send signals to and receive signals from air handler 176, defrost heater 270, thermostat 272, and user interface panel 148. Controller 190 may further be operably coupled to other suitable components of the appliance 100 to facilitate operation of the appliance 100 generally. FIG. 17 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure.

Referring to FIG. 17, at 610, the method 600 includes initiating a defrost cycle. For instance, 610 may be initiated upon determination that a frost state has been reached. In some such embodiments, the determination is made in response to receiving a temperature signal (e.g., from the defrost thermostat) that is below a set temperature. Optionally, the set temperature may be determined to have been sustained over a preset amount of time. Additionally or alternatively, 610 may be initiated at a set time interval or time of day that has been programmed into controller. In further additional or alternative embodiments, 610 may be initiated in response to a user request signal received, for example, from the user interface panel. In still further additional or alternative embodiments, 610 may be initiated in response to a detected number of ice harvest cycles completed at the icemaker. In yet further additional or alternative embodiments, 610 may be initiated in response to a detected run time of the compressor.

At 620, the method 600 includes deactivating the air handler in fluid communication with the convection compartment. For instance, rotation of the air handler or motivation of air thereby may be restricted at 620. In other words, if the air handler had previously been active to motivate air, such actions may be restricted at 620. Moreover, further activation of the air handler may be prevented for the duration of method 600. In optional embodiments, additional air handlers, such as an air handler motivating a freezer airflow within the freezer chamber, may be deactivated at 620.

At 630, the method 600 may include activating the defrost heater in thermal communication with the convection compartment. For instance, a voltage or current may be directed to the defrost heater in response to the air handler being deactivated. Alternatively, the defrost heater may be activated simultaneously with the deactivation of the air handler at 620.

At 640, the method 600 may include determining a defrosted state. Specifically, 640 may include receiving a temperature signal, such as from the defrost thermostat within the convection compartment. Upon receiving the temperature signal, or in the alternative to receiving a temperature signal, the method 640 may proceed to evaluating whether a set temperature (e.g., defrost temperature) has been reached or exceeded. If the set temperature has not been reached or exceeded, 640 may proceed to evaluating whether a set time interval or period has been reached or exceeded. If the set time interval has not been reached, the method 600 may return to evaluating whether the set temperature has been reached. If the set time interval has been reached or exceeded, the method 600 may proceed to 650. Similarly, if the set temperature has been evaluated as reaching or exceeding the set temperature, the method 600 may proceed to 650.

At 650, the method 600 may include deactivating the defrost heater. In other words, the defrost heater may cease generating and/or directing heat to the convection compartment. Subsequently, further operations (e.g., of the air handler) may be resumed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet comprising an internal liner defining a freezer chamber and a fresh food chamber;

a door attached to the cabinet to selectively restrict access to the fresh food chamber or the freezer chamber in a closed position;

a secondary liner attached to the cabinet, the secondary liner defining a sub-compartment in fluid isolation from the freezer chamber and the fresh food chamber in the closed position;

a heat exchange case attached to the internal liner in conductive thermal communication with the internal liner, the heat exchange case at least partially defining a convection compartment along a portion of the internal liner to direct heat to the freezer chamber, the convection compartment being defined in fluid isolation from the freezer chamber and in fluid communication with the sub-compartment in the closed position, the convection compartment comprising a non-linear airflow path extending from a return outlet to a supply inlet;

a partition wall extending within the convection compartment and defining at least a portion of the non-linear airflow path; and an air handler mounted on the partition wall within the convection compartment to motivate air between the sub-compartment and the convection compartment.

2. The refrigerator appliance of claim 1, wherein the secondary liner is positioned on the door, and wherein the sub-compartment is defined within the door.

3. The refrigerator appliance of claim 1, wherein the heat exchange case is positioned within the freezer chamber.

4. The refrigerator appliance of claim 1, further comprising an air handler in fluid communication with the freezer chamber to direct a freezer airflow toward the convection compartment.

5. The refrigerator appliance of claim 1, further comprising a defrost heater in thermal communication with the convection compartment.

6. The refrigerator appliance of claim 1, wherein the convection compartment is an evaporator-free compartment.

7. A refrigerator appliance comprising:

a cabinet comprising an internal liner defining a freezer chamber and a fresh food chamber;

a fresh food door attached to the cabinet at to selectively restrict access to the fresh food chamber in a first closed position;

a freezer door attached to the cabinet at to selectively restrict access to the freezer chamber in a second closed position;

a secondary liner attached to the cabinet, the secondary liner defining a sub-compartment in fluid isolation from the freezer chamber and the fresh food chamber in the first closed position;

a heat exchange case attached to the internal liner in conductive thermal communication with the internal liner, the heat exchange case at least partially defining a convection compartment along a portion of the internal liner to direct heat to the freezer chamber, the convection compartment being defined in fluid isolation from the freezer chamber and in fluid communication with the sub-compartment in the first closed position, the convection compartment comprising a non-linear airflow path extending from a return outlet to a supply inlet;

a partition wall extending within the convection compartment and defining at least a portion of the non-linear airflow path; and an air handler mounted on the partition wall within the convection compartment to motivate air between the sub-compartment and the convection compartment.

8. The refrigerator appliance of claim 7, wherein the secondary liner is positioned on the fresh food door, and wherein the sub-compartment is defined within the fresh food door.

9. The refrigerator appliance of claim 7, wherein the heat exchange case is positioned within the freezer chamber.

10. The refrigerator appliance of claim 7, further comprising an air handler in fluid communication with the freezer chamber to direct a freezer airflow toward the convection compartment.

11. The refrigerator appliance of claim 7, further comprising a defrost heater in thermal communication with the convection compartment.

12. The refrigerator appliance of claim 7, wherein the convection compartment is an evaporator-free compartment.

* * * * *